US005412908A

United States Patent [19]

Wild

[11] Patent Number: 5,412,908

[45] Date of Patent: May 9, 1995

[54] AUTOMATIC VAULT HATCH

[75] Inventor: Paul Wild, Elk Grove, Calif.

[73] Assignee: Wild Automatic Door, Inc., Elk Grove, Calif.

[21] Appl. No.: 45,493

[22] Filed: Apr. 8, 1993

[51] Int. Cl.[6] ..... E05F 11/24

[52] U.S. Cl. ..... 49/340; 49/139; 49/141

[58] Field of Search ..... 49/340, 345, 139, 141

[56] References Cited

U.S. PATENT DOCUMENTS

| | | | |
|---|---|---|---|
| 4,210,277 | 7/1980 | Kolt | 49/340 X |
| 4,333,270 | 6/1982 | Catlett | 49/336 |
| 4,337,670 | 7/1982 | Carlson | 49/139 X |
| 4,348,835 | 9/1982 | Jones et al. | 49/340 X |
| 4,735,018 | 4/1988 | Duncan et al. | 49/139 X |
| 4,871,676 | 10/1989 | Yamada | 49/340 X |
| 5,018,304 | 5/1991 | Longoria | 49/340 |

*Primary Examiner*—Philip C. Kannan
*Attorney, Agent, or Firm*—Brumbaugh, Graves, Donohue & Raymond

[57] ABSTRACT

A utility vault shroud having a hatch cover is provided with a motorized operator for opening and closing a hatch for access thereto. The operator is mounted across the shroud access opening between the side walls thereof with a horizontal shaft which is connected to the hatch cover by pivot arms. In a preferred arrangement a battery back-up is provided for operation during power failure.

5 Claims, 1 Drawing Sheet

AUTOMATIC VAULT HATCH

BACKGROUND OF THE INVENTION

The present invention relates to utility vaults and the hatches provided for access thereto. In particular, the invention provides a motorized operator for opening and closing the vault hatch.

Hatches for utility vaults are usually manually opened and closed by service personnel. It has been brought to the attention of the inventor that to obtain access to such vaults, service personnel must unlock and manually open the hatch. After opening, the service person secures a detent provided to hold the hatch open, and enters the vault shroud to descend a service ladder to the underground vault interior. While still standing on the ladder, and possibly holding tools, service equipment and spare parts, the service person must release the detent, and close the hatch as he or she descends the ladder to the vault interior. This operation can be awkward and prone to accidental falls and injury.

Automatic swing door operators, as disclosed in U.S. Pat. No. 4,333,270 to John C. Catlett, are commonly used for vertically-mounted, conventional swing doors. Such operators are mounted either within the door header or on the one side of the door frame above the door, outside of the door opening. Since vault hatches have neither a door header nor a surrounding frame, door openers cannot be conventionally mounted thereto. Further, the motivation for providing automatic door operation in most instances, i.e., convenience of customers and frequent door use, are absent in the instance of a vault hatch. Finally, the vault hatch environment provides special problems associated with power or equipment failure not found in the conventional door application.

It is therefore an object of the present invention to provide improved safety in connection with service personnel entering or leaving a utility vault, by providing a motorized vault hatch operating system.

SUMMARY OF THE INVENTION

In accordance with the present invention there is provided a motorized operator system for a utility vault hatch having a rectangular vault shroud having a horizontal width and length, and having a horizontally oriented access opening at the top of said shroud of corresponding width and length. The vault has a vault hatch for closing the access opening, which is in a horizontal orientation in the closed position and is hinged to the vault shroud along one edge corresponding to the shroud length. The operator includes a swing door operator having a rotating shaft, means for mounting the operator across the width of the shroud on the interior thereof, with the axis of the shaft oriented horizontally and parallel to the swing access of said hatch. A first pivot arm is fixedly connected to the shaft for rotation therewith. A second pivot arm is pivotably connected between the first pivot arm and the hatch. Control means are provided for operating the door operator to swing the hatch between open and closed positions.

The operator is preferably provided with a battery backup power supply. Reinforcement members extending along the interior length of the hatch and having a flange mounted thereon may be provided for connecting to the second pivot arm. The operator may include control means which are connected to operate in response to the operation of an electrically operated lock. The first and second pivot arms may be interconnected by a removable pivot pin to provide for manual opening of the hatch in the event of operator failure.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENT

Figure 1:
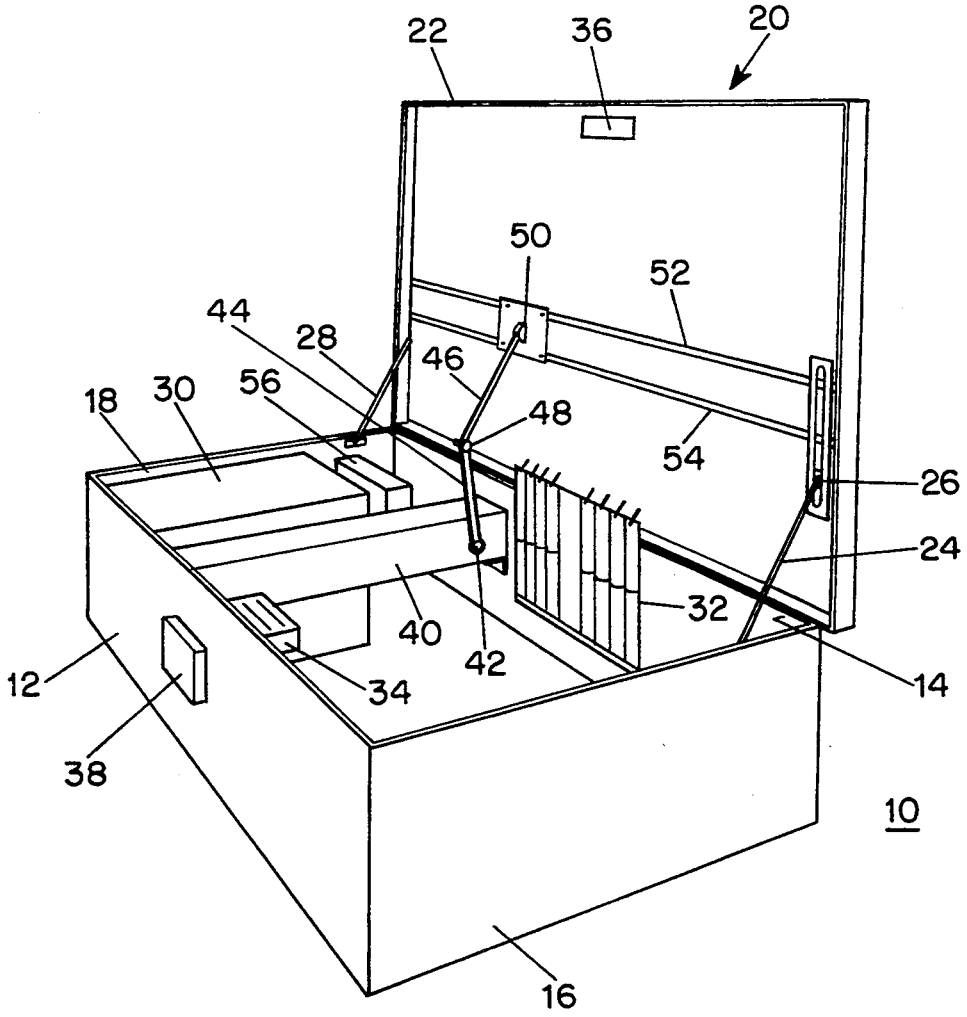
FIG. 1 is a perspective view of a vault shroud and hatch equipped with the operator system of the present invention.

FIG. 1 is a perspective view of a vault shroud and hatch having an operator in accordance with the present invention.

The vault shroud 10 is a portion on a utility vault which is visible from above ground, and which provides access to a utility vault positioned below ground.

As illustrated in FIG. 1 the vault shroud 10 includes side walls 12, 14 and end walls 16, 18 such that walls 12 and 14 define the length and height of the shroud while walls 16 and 18 define the width and height of the shroud. A vault hatch 20 is hingedly mounted to wall 14 of shroud 10 to pivot between a generally horizontal closed position and a vertical open position, as illustrated in FIG. 1. Hatch 20 is conventionally provided with a lip 22 which prevents entry of water into the vault when hatch 20 is closed.

A strut 24 with a detent 26 is conventionally provided to hold hatch 20 in the open position when service personnel are entering the vault. A strut 28 limits the opening swing of hatch 20 and holds hatch 20 in the vertical position against the force of wind from a direction tending to further swing the hatch away from the closed position. Shroud 10 may include certain utility equipment, as shown at 30 which is arranged for access without descending in to the vault.

What has thus far been described is a conventional utility vault access shroud and hatch. When service personnel require access to a vault, hatch 20 is opened from outside manually and the service person enters the shroud and descends a ladder, for example, along the inside of wall 16 (not shown) thereby to proceed to the underground vault. While standing near the top of the ladder, the service person is required to close the vault hatch 20, to keep out adverse weather and to prevent intentional or accidental entry of intruders, while working within. To accomplish this hatch closing manually, the service person must release detent 26 and lower hatch 20 above his head while atop the access ladder. The service person may be burdened with tools, equipment and supplies while performing this operation. The need for this operation has been perceived as presenting a safety hazard to the service personnel.

Figure 2:
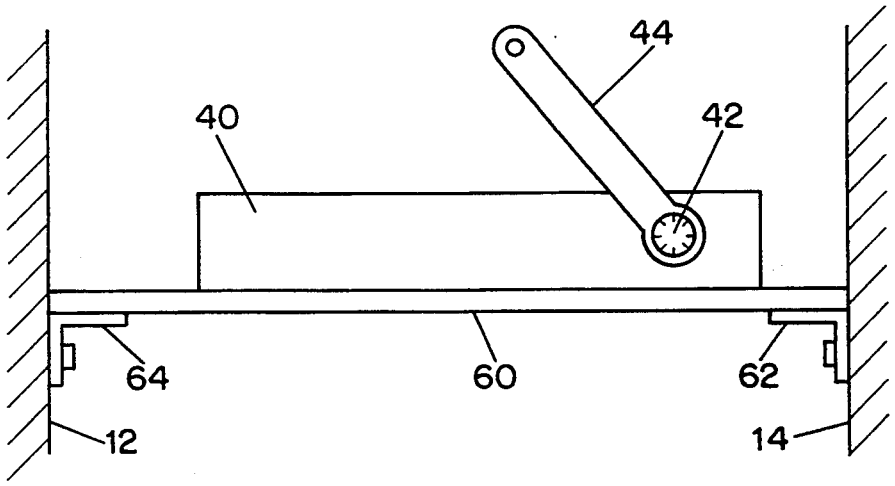
FIG. 2 is a partial elevation cross-sectional view thereof.

While the use of motorized door operators for swing doors mounted in a vertical configuration within a surrounding wall have been known, the usual configurations of such operators are not suitable for application to a vault shroud and hatch as set forth above. The present invention includes a mechanical door operator 40 of the type described in the aforesaid Catlett patent which includes a mechanically rotated shaft 42 and a first pivot arm 44 affixed thereto, for example, by a spline. As shown in FIG. 1, and in greater detail in the cross-section view of FIG. 2, operator 40 is mounted on a transverse support member 60 which may, for example, comprise a Unistrut members extending between angle brackets 62 and 64, which are mounted respectively to the interior surfaces of walls 12 and 14, such that the operator extends transversely across the shroud access opening. First pivot member 44 is pivotable connected to a second pivot member 46 which is pivoted by its other end on flange 50. A removable pivot pin 48 interconnects the two pivot arms, and can be removed for emergency egress from the vault in the event of operator failure. Flange 50 is mounted on transverse structural supports 52 and 54, also of Unistrut material to distribute the force of the door operator along the length of hatch 20. Springs 32, which are conventionally provided, assist the operator in opening of hatch 20.

In order to adapt the operator 40 to the heavier load conditions that may be experienced in lifting a vault hatch, the operator was provided with a power supply circuit to drive its D.C. motor having a higher current capacity than generally provided by the manufacturer (Besam, Inc.) for use with vertical doors. The operating system of the present invention is also provided with a battery back-up power supply 56 which may, for example, be a Back-UPS 450 unit, available from APC of West Kingston, R.I. The battery back-up provides for motorized operation of the hatch opener under conditions of power failure. This is important since power failure conditions may necessitate access to a utility vault by service personnel or to assist emergency egress in a "power failed" condition.

As shown in FIG. 1, shroud 10 is provided with a magnetic lock 34 interacting with lock plate 36 on hatch 20 and operated by device 38, such as a magnetic card reader or code entry keypad. The operator is preferably activated to open hatch 20 immediately after the opening of magnetic lock 34.

A further control, such as a push button switch is provided within the vault to provide unlocking to lock 34 and activation of operator 40 by a service person working therein to effect egress.

While there has been described what is believed to be the preferred embodiment of the invention, those skilled in the art will recognize that other and further modifications may be made thereto without departing from the spirit of the invention, and it is intended to claim all such changes and modifications as fall within the scope of the invention.

I claim:

1. A motorized operator system for a utility vault hatch having a rectangular vault shroud having a horizontal width and length, and a horizontally oriented access opening of corresponding width and length, and having a vault hatch for closing said access opening, said hatch having a horizontal orientation in the closed position and being hinged to said vault shroud along one edge corresponding to the shroud length, said operator comprising a swing door operator having a rotating shaft, means for mounting said operator across the width of said shroud on the interior thereof, with the axis of said shaft oriented horizontally and parallel to the swing axis of said hatch, a first pivot arm fixedly connected to said shaft for rotation therewith, a second pivot arm pivotably connected to said first pivot arm and said hatch, and control means for operating said door operator to swing said hatch between open and closed positions.

2. An operator a specified in claim 1 further including a battery back-up power supply for said operator.

3. An operator as specified in claim 1 further comprising reinforcement members extending along the interior length of said hatch and having a flange mounted thereon for connection to said second pivot arm.

4. An operator as specified in claim 1 wherein said hatch is provided with an electrically operated lock and wherein said control means responds to opening of said lock to activate said operator to open said hatch.

5. An operator as specified in claim 1 wherein said first and second pivot arms are connected by a removable pin, whereby said hatch can be manually opened.

* * * * *